United States Patent [19]

Harrington

[11] Patent Number: 4,828,521

[45] Date of Patent: May 9, 1989

[54] SWIMMER'S PROPULSION ENHANCER AND TRAINING DEVICE AND METHOD

[75] Inventor: Marlin K. Harrington, Crawfordsville, Ind.

[73] Assignee: Harrington Products, Inc., Crawfordsville, Ind.

[21] Appl. No.: 72,416

[22] Filed: Jul. 13, 1987

[51] Int. Cl.[4] ..... A63B 31/06

[52] U.S. Cl. ..... 441/60; 441/61

[58] Field of Search ..... 441/55-64; 434/254; 128/87 R, 922

[56] References Cited

U.S. PATENT DOCUMENTS

| | | | |
|---|---|---|---|
| 476,040 | 5/1892 | Curran | 441/60 |
| 579,758 | 3/1897 | Luce | 441/60 |
| 1,767,651 | 6/1930 | Cuthbertson | 441/60 |
| 1,843,582 | 2/1932 | Schmitt | 441/60 |
| 1,909,259 | 5/1933 | Feir | 441/60 |
| 2,013,520 | 9/1935 | McDermott | 434/254 |
| 2,746,658 | 5/1956 | Freid | 224/28 |
| 3,344,449 | 10/1967 | Grilli | 441/60 |
| 3,789,447 | 2/1974 | Lavallee | 441/59 |
| 3,835,493 | 9/1974 | Grivna | 441/59 |
| 4,073,328 | 2/1978 | Franklin | 150/1.5 R |
| 4,665,905 | 5/1987 | Brown | 128/87 R |
| 4,708,131 | 11/1987 | Kendrick | 128/87 R |

FOREIGN PATENT DOCUMENTS

| | | | |
|---|---|---|---|
| 178223 | 11/1906 | Fed. Rep. of Germany | 441/60 |

*Primary Examiner*—Joseph F. Peters, Jr.
*Assistant Examiner*—Edwin L. Swinehart
*Attorney, Agent, or Firm*—Woodard, Emhardt, Naughton, Moriarty & McNett

[57] ABSTRACT

A device and method for swimmers to enhance propulsion from the winner's kick. The device resists flexure of the swimmer's knees by providing a first band secured typically to the thigh, a second band secured typically to the lower leg, and a flexurally resistant member coupled to the first and second bands. By resisting knee flexure, the swimmer is forced to power a flutter kick with hip muscles rather than leg muscles, resulting in a generally more powerful and efficient flutter kick. In one embodiment, the bands secured to the legs may include Velcro for a snug fit. Also, the flexurally resistant member may comprise a graphite or fiberglass rod. A sliding member, such as a ring around the flexurally resistant member, may be provided with a line to prevent loss of a detached flexurally resistant member. Also, the flexurally resistant member may be snapped into fittings for quick assembly or release.

15 Claims, 3 Drawing Sheets

SWIMMER'S PROPULSION ENHANCER AND TRAINING DEVICE AND METHOD

BACKGROUND OF THE INVENTION

This invention relates generally to an apparatus for swimmers, and more generally to an apparatus for resisting knee flexure during a swimmer's flutter kick.

A swimmer obtains motive propulsion through the water both from the swimmer's arms and legs. In many instances, such as competitive swimming, frictional drag caused by the legs is a significant concern, tending to slow a swimmer down. When utilizing a flutter kick, often streamlining the swimmer's flow through the water is as great of a concern as the amount of propulsion provided by the kicking legs. Such streamlining is enhanced by keeping the swimmer's legs relatively straight rather than bending them excessively at the knees. Excessive bending at the knees not only causes excessive frontal drag, but also may reduce the amount of kicking force properly available to the swimmer. Such improper kicks lead to inefficiencies and corresponding fatigue and reduction in swimmer performance. This is a concern not only to competitive swimmers racing for speed, but also to underwater swimmers, such as scuba divers, who will tire, and correspondingly utilize more of their precious compressed air if they do not optimize their swimming efficiency.

Several devices for swimmers have been designed. For example, several devices using a "check valve" approach to increasing swimmers' propulsion have been designed, such as U.S. Pat. No. 1,767,651 to Cuthbertson, U.S. Pat. No. 3,789,447 to Lavallee, U.S. Pat. No. 579,758 to Luce, and German Pat. No. 178,223 to Schroder. The Cuthbertson and Luce devices disclose swimming appliances attached to the leg below the knee. The Lavallee device discloses a swimming accessory attached to the forearm of a swimmer, and the Schroder device shows a swimming appliance attached at the ankle and waist of the swimmer. These devices have hinged flaps which provide greater resistance when moved in the direction of movement of the power stroke than when moved in the direction of the return stroke. U.S. Pat. No. 3,835,493 to Grivna discloses another swimmer's appliance for providing resistance against water during a power stroke.

It is also desirable to train swimmers to use proper form in their flutter kicks. More specifically, it is desirable to have swimmers develop the use of their hip muscles for powering the flutter kick while de-emphasizing the use of leg muscles. U.S. Pat. No. 2,013,520 to McDermott discloses an apparatus for the use in instruction of swimming. The McDermott apparatus is a landbased apparatus having clasps to engage and hold the ankles and leg supports against which the swimmer's legs push to simulate water resistance. Such devices are used in training, and then during actual competition the swimmer performs without the apparatus, having improved form.

U.S. Pat. No. 1,909,259 to Feir discloses a stabilizing support device for bodies on water. The Feir device includes straps along the length of the supported person's legs and waist, and includes hinge "45 to permit free bending of the leg at the knee." Feir, col. 2, lines 32–33.

While the above devices provide certain advantages, none of them provide the same advantages in the same way as the present invention.

SUMMARY OF THE INVENTION

According to one embodiment, the present invention provides a device to be worn on a leg of a swimmer comprising means for securing around the swimmer's thigh; means for securing around the swimmer's lower leg; and a flexurally resistant member coupled to the means for securing around the swimmer's thigh and to the means for securing around the swimmer's lower leg, wherein the flexurally resistant member provides resistance to bending of the swimmer's knee.

According to another embodiment, the present invention provides a method of resisting flexure of a swimmer's knees during a flutter kick comprising the steps of securing to the swimmer's right thigh a right upper band around the swimmer's right thigh; securing to the swimmer's right lower leg a right lower band around the swimmer's right lower leg, the right lower band having a right flexurally resistant member coupled thereto and coupled to the right upper band; securing to the swimmer's left thigh a left upper band around the swimmer's left thigh; securing to the swimmer's left lower leg a left lower band around the swimmer's left lower leg, the left lower band having a left flexurally resistant member coupled thereto and coupled to the left upper band; and thereafter flutter kicking the swimmer's legs in water, wherein the kicking step includes the step of resisting knee flexure with the right flexurally resistant member and with the left flexurally resistant member.

A general object of the present invention is to provide an improved swimmer's propulsion enhancer.

These and other objects of the present invention are disclosed in the specification.

DESCRIPTION OF THE PREFERRED EMBODIMENT

Figure 1:
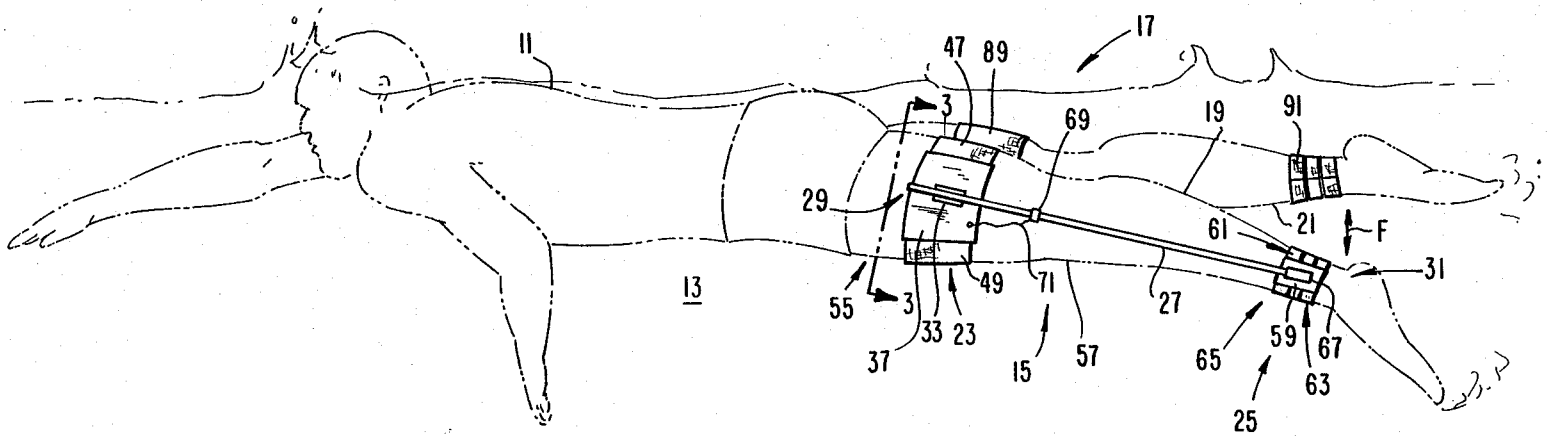
FIG. 1 is a side view of a swimmer wearing a pair of the swimmer's propulsion enhancer and training devices of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figures 2, 3, 4:
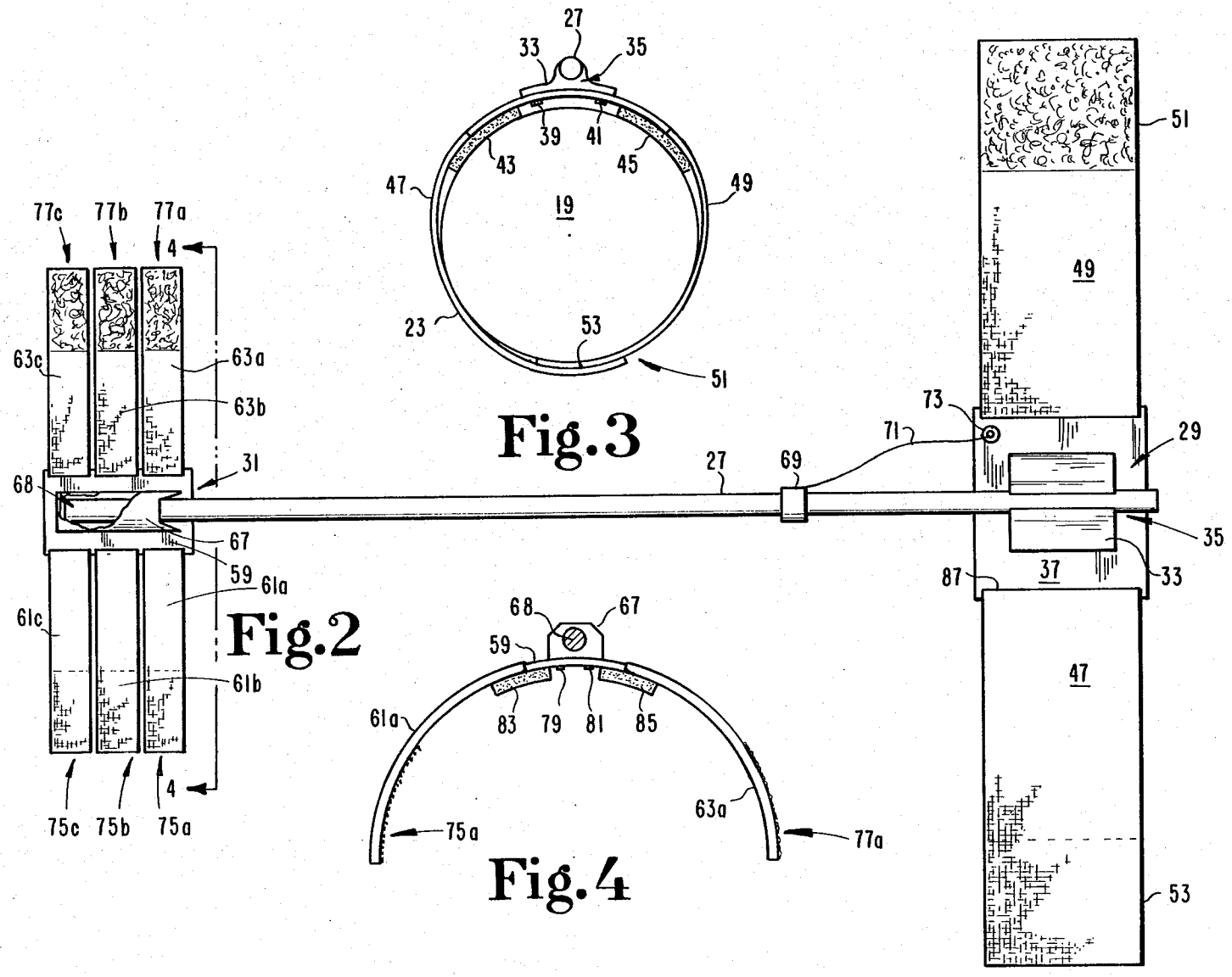
FIG. 2 is a partial cutaway side view of the device of FIG. 1 removed from the swimmer.
FIG. 3 is a front view of the device of FIG. 1 taken along lines 3—3.
FIG. 4 is a front view of the device of FIG. 2 taken along line 4—4.

Referring now to FIGS. 1, 2, 3 and 4, swimmer 11 is shown swimming in water 13 and wearing a pair of swimmer's propulsion enhancers 15 and 17 on the swimmer's left leg 19 and right leg 21, respectively. Swimmer 11 is shown doing a crawl stroke in which his legs are kicked upwardly and downwardly in a conventional flutter kick as shown by arrow "F". The swimmer's propulsion enhancer on the left leg includes left upper band 23 and left lower band 25 which are each coupled to flexurally resistant member 27. Flexurally resistant member 27 is typically an elongated rod made of graphite or fiberglass having a round cross section. The flexurally resistant member has an upper end 29 and a lower end 31. Upper end 29 is snap-fitted into longitudinal yoke 33 which is typically made of a flexible hard plastic or steel. As seen in FIG. 3, yoke 33 has a hemi-cylindrical crescent 35 cut therein to receive the circular cross section of flexurally resistant member 27. Due to the resiliency of yoke 33, flexurally resistant member 27 may be snapped in or out thereof in a matter of seconds. Such snap-in feature is not unlike the notches used to hold arrows in U.S. Pat. Nos. 2,746,658 to Freid and 4,073,328 to Franklin. Longitudinal yoke 33 is a fitting mounted to upper bracket body 37 by means, such as stainless steel screws 39 and 41. Alternatively, a fitting, such as yoke 33, may be cast homogeneously with bracket body 33. Upper bracket body 37 may be relatively rigid and conform generally to the outer profile of leg 19, while having some inherent flexibility to adapt to varying leg sizes. Upper body bracket 37 has foam padding 43 and 45 to provide comfort to the swimmer and to minimize wear or chafing from the upper bracket body or screws. Nylon straps 47 and 49 are flexible and, along with upper bracket body 37, make up left upper band 23 secured to leg 19. Nylon strap 49 includes Velcro pile 51 which engages Velcro hooks 53 on strap 47, causing nylon straps 47 and 49 to be coupled, thus encircling leg 19 with left upper band 23. In such way, left upper band 23 secures to thigh 55 of the swimmer above left knee 57 and below the swimmer's hip.

Left lower band 25 includes lower bracket body 59, and nylon straps 61 and 63. Nylon straps 61 and 63 have Velcro pile and hooks substantially similar to Velcro pile 51 and Velcro hooks 53 utilized in left upper band 23. Thus, left lower band 25 is secured around the lower leg 65 of the swimmer near the swimmer's left ankle. The lower leg is meant to define the swimmer's anatomy below knee 57, including the ankle and foot. Lower end 31 of flexurally resistant member 27 is mounted to lower bracket body by a fitting 67 having a longitudinal cup therein for receiving the end of member 27.

Lanyard retainer ring 69 encircles flexurally resistant member 27 and is attached to upper body bracket 37 by Lanyard line 71 and grommet fitting 73. The ring and line act to prevent member 27 from being lost in the water if member 27 becomes detached from its fittings.

As can be seen in FIG. 2, nylon straps 61 and 63 actually comprise three individual nylon straps each, 61*a*, 61*b*, 61*c*, 63*a*, 63*b*, and 63*c*. There is a corresponding Velcro hook 75*a*, 75*b*, and 75*c*, and Velcro pile 77*a*, 77*b*, and 77*c* which engage each other to hold their respective nylon straps snugly around the swimmer's lower leg.

Note that the nylon straps, such as nylon strap 47, is coupled to upper bracket body 37 at longitudinal slot 87 (FIG. 2). Other nylon straps are coupled to their corresponding bracket bodies at similar longitudinal slots.

Longitudinal cup 68 is shown in FIG. 2, by fitting 67 being partially cut away. Longitudinal cup 68 receives lower end 31 of flexurally resistant member 27.

FIG. 4 shows a front view of left lower band 25 separated from the lower leg of the swimmer. Flexurally resistant member 27 is shown in section in the longitudinal cup 68 in fitting 67. Stainless steel screws 79 and 81 hold fitting 67 to lower bracket body 59. Foam pads 83 and 85 provide comfort and an improved fit on the lower leg of the swimmer.

In FIG. 1, right upper band 89 is substantially similar to left upper band 23 except it is mounted on the right thigh of the swimmer. Also, right lower band 91 is likewise similar to left lower band 25 except that it is worn on the swimmer's right lower leg. There is a flexurally resistant member (not shown) coupling right upper band 89 with right lower band 91, substantially similar to the way that member 27 couples its respective bands.

Figure 5:
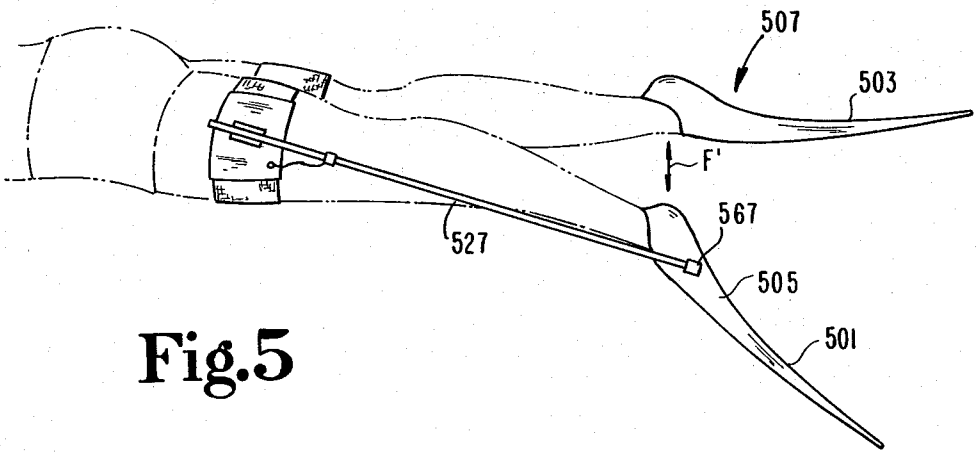
FIG. 5 is a side view of a swimmer wearing an alternative embodiment of the swimmer's propulsion enhancer of the present invention.

Referring now to FIG. 5, an alternative embodiment of the present invention is shown utilizing swim fins 501 and 503. The reference numbers shown in FIG. 5 begin with a "500 series" prefix, but otherwise denote substantially similar structure as previously discussed with FIGS. 1 through 4. Swim fin 501 has an outside edge 505, and swim fin 503 has an outside edge 507. A fitting, such as fitting 567, is mounted to outside edge 505, rather than lower bracket body 59 as shown in FIGS. 1, 2 and 4. Flexurally resistant member 527 is substantially the same as member 27 previously discussed, except that member 527 is longer and is mounted in a longitudinal cup in fitting 567. The swim fins are worn on the swimmer's feet, as is conventionally known, and provide additional thrust for the swimmer during a flutter kick, shown as F'.

To use the present invention, the swimmer first secures the right upper band to his right thigh, secures the right lower band to his right lower leg, secures the left upper band to his left thigh, secures the left lower band to his left lower leg, and then installs the flexurally resistant members for each leg into the bands. This is accomplished by placing the lower end of the flexurally resistant member in the longitudinal cup of the fitting mounted to the lower band and then snapping the flexurally resistant member into the longitudinal yoke mounted to the upper band for each leg. The swimmer then proceeds to swim in water, using a flutter kick as known in the art of swimming. During the flutter kick, the left and right legs of the swimmer are moved upwardly and downwardly as shown by arrow "F" in FIG. 1, and arrow "F'" in FIG. 5. The flexurally resistant members resist knee flexure by the swimmer, requiring the swimmer to power the flutter kick using primarily hip muscles rather than leg muscles. During the flutter kick, some flexure may occur, elastically bending the flexurally resistant member (typically a graphite or fiberglass rod). This bending creates potential spring energy in the flexurally resistant rod, which later may be converted to potential energy during the power downstroke in a flutter kick as the rod straightens out.

Various flexurally resistant members with varying degrees of stiffness may be provided. This is accomplished by using various cross sectional moments of inertia, as accomplished by varying cross sectional diameter, as well as using materials with a different modulus of elasticity. In this way, the swimmer may vary the resistivity to knee flexure, allowing the swimmer to progressively work up to greater development of the hip muscles properly used for a flutter kick. This is especially useful in training of a competitive swimmer.

The swimmer may train using the present invention by initially using a more flexible flexurally resistant member. Over time, the swimmer progresses by training with stiffer flexurally resistant members, developing strong hip muscles for the flutter kick. During competition, the present invention is removed, the swimmer having developed improved form and strength by use of the present invention. The improved form of the flutter kick should include a swiveling action of the hips through the water, resulting in a faster and more efficient stroke.

Finally, the specific gravity of the device of the present invention may vary, but it is believed that in the best mode, the specific gravity should be approximately the same as that of the water in which the device is to be used.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A device to be worn on a leg of a swimmer comprising:

means for securing to the swimmer's thigh;

means for securing to the swimmer's lower leg;

a flexurally resistant member coupled to said means for securing to the swimmer's thigh and to said means for securing to the swimmer's lower leg, wherein said flexurally resistant member provides resistance to bending of the swimmer's knee; and line means for holding said flexurally resistant member in a mode detached from said means for securing to the swimmer's thigh.

2. The device of claim 1 wherein said flexurally resistant member has a first end and a second end, and wherein said means for securing to the swimmer's thigh further includes a first fitting for receiving said first end of said flexurally resistant member, and wherein said means for securing to the swimmer's lower leg further includes a second fitting for receiving said second end of said flexurally resistant member, said flexurally resistant member being removably mounted in said first fitting and said second fitting.

3. The device of claim 2 wherein said first fitting includes a longitudinal yoke for snappably receiving said first end of said flexurally resistant member.

4. The device of claim 3 wherein said second fitting includes a longitudinal cup for receiving said second end of said flexurally resistant member.

5. The device of claim 4 wherein said flexurally resistant member comprises a graphite rod.

6. The device of claim 4 wherein said flexurally resistant member comprises a fiberglass rod.

7. A device to be worn on a leg of a swimmer comprising:

means for securing to the swimmer's thigh;

means for securing to the swimmer's lower leg;

a flexurally resistant elastic member coupled to said means for securing to the swimmer's thigh and to said means for securing to the swimmer's lower leg, wherein said flexurally resistant member provides resistance to bending of the swimmer's knee; and line means for holding said flexurally resistant member in a mode detached from said means for securing to the swimmer's thigh.

8. A device to be worn on a leg of a swimmer comprising:

means for securing to the swimmer's thigh;

means for securing to the swimmer's lower leg;

a flexurally resistant elastic member coupled to said means for securing to the swimmer's thigh and to said means for securing to the swimmer's lower leg, wherein said flexurally resistant member provides resistance to bending of the swimmer's knee; and wherein said means for securing to the swimmer's thigh includes a flexible strap, wherein said means for securing to the swimmer's thigh further includes a hook and pile closure for securing said flexible strap to the thigh, and wherein said means for securing to the swimmer's lower leg comprises a swim fin adapted to be worm on the swimmer's foot.

9. A device to be worn on a swimmer's leg, said leg having a portion below the hip and above the knee, and a portion below the knee, comprising:

first means for securing to a first leg portion;

second means for securing to a second leg portion, said second means for securing including a hook and pile closure for securing said second means for securing to said second leg portion; and a flexurally resistant elastic member coupled to said first means for securing and to said second means for securing, wherein said flexurally resistant member provides resistance to bending of the swimmer's knee.

10. The method of resisting flexure of a swimmer's knees during a flutter kick comprising the steps of:

securing to the swimmer's right thigh a right upper band around to the swimmer's right thigh;

securing to the swimmer's right lower leg a right lower band around the swimmer's right lower leg, said right lower band having a right flexurally resistant member coupled thereto and coupled to said right upper band;

securing to the swimmer's left thigh a left upper band around the swimmer's left thigh;

securing to the swimmer's left lower leg a left lower band around the swimmer's left lower leg, said left lower band having a left flexurally resistant member coupled thereto and coupled to said left upper band; and thereafter flutter kicking the swimmer's legs in water, wherein said kicking step includes the step of resisting knee flexure with said right flexurally resistant member and with said left flexurally resistant member, wherein at least one of said flexurally resistant members comprises a graphite rod, and wherein said resisting step includes the step of elastically bending said graphite rod.

11. The method of resisting flexure of a swimmer's knees during a flutter kick comprising the steps of:

securing to the swimmer's right thigh a right upper band around the swimmer's right thigh;

securing to the swimmer's right lower leg a right lower band around the swimmer's right lower leg, said right lower band having a right flexurally resistant member coupled thereto and coupled to said right upper band;

securing to the swimmer's left thigh a left upper band around the swimmer's left thigh;

securing to the swimmer's left lower leg a left lower band around the swimmer's left lower leg, said left lower band having a left flexurally resistant member coupled thereto and coupled to said left upper band; and thereafter flutter kicking the swimmer's legs in water, wherein said kicking step includes the step of resisting knee flexure with said right flexurally resistant member and with said left flexurally resistant member, wherein at least one of said flexurally resistant members comprises a fiberglass rod, and wherein said resisting step includes the step of elastically bending said fiberglass rod.

12. The method of resisting flexure of a swimmer's knees during a flutter kick comprising the steps of:

securing to the swimmer's right thigh a right upper band around the swimmer's right thigh;

securing to the swimmer's right lower leg a right lower band around the swimmer's right lower leg, said right lower band having a right flexurally resistant elastic member coupled thereto and coupled to said right upper band;

securing to the swimmer's left thigh a left upper band around the swimmer's left thigh;

securing to the swimmer's left lower leg a left lower band around the swimmer's left lower leg, said left lower band having a left flexurally resistant elastic member coupled thereto and coupled to said left upper band;

thereafter flutter kicking the swimmer's legs in water, wherein said kicking step includes the step of resisting knee flexure with said right flexurally resistant member and with said left flexurally resistant member; and snapping said right flexurally resistant member into a fitting mounted to said right upper band, said snapping step occurring prior to said kicking step.

13. The method of claim 12 wherein said right lower band comprises a first swim fin adapted to be worn on the swimmer's right foot and wherein said left lower band comprises a second swim fin adapted to be worn on the swimmer's left foot, and wherein said step of flutter kicking comprises the step of flutter kicking said first and second swim fins.

14. The method of resisting flexure of a swimmer's knees during a flutter kick comprising the steps of:

securing to the swimmer's right thigh a right upper band around the swimmer's right thigh;

securing to the swimmer's right lower leg a right lower band around the swimmer's right lower leg, said right lower band having a right flexurally resistant elastic member coupled thereto and coupled to said right upper band;

securing to the swimmer's left thigh a left upper band around the swimmer's left thigh;

securing to the swimmer's left lower leg a left lower band around the swimmer's left lower leg, said left lower band having a left flexurally resistant elastic member coupled thereto and coupled to said left upper band; and thereafter flutter kicking the swimmer's legs in water, wherein said kicking step includes the step of resisting knee flexure with said right flexurally resistant member and with said left flexurally resistant member.

15. The method of claim 14 wherein said right lower band comprises a first swim fin adapted to be worn on the swimmer's right foot and wherein said left lower band comprises a second swim fin adapted to be worn on the swimmer's left foot, and wherein said step of flutter kicking comprises the step of flutter kicking said first and second swim fins.

* * * * *